United States Patent [19]

Faltin

[11] Patent Number: 4,678,172

[45] Date of Patent: Jul. 7, 1987

[54] HIGH SPEED ON-LINE RESHINGLING OF PRINTED PRODUCTS

[75] Inventor: Hans G. Faltin, York, Pa.

[73] Assignee: Custom-Bilt Machinery, Inc., York, Pa.

[21] Appl. No.: 813,878

[22] Filed: Dec. 27, 1985

[51] Int. Cl.[4] ..... B41F 13/64

[52] U.S. Cl. ..... 270/18; 198/460; 198/440; 271/202; 271/204; 271/302

[58] Field of Search ..... 101/2, 232-241; 198/460-461, 440-441, 436-437; 271/302, 202, 204; 270/1.1, 18

[56] References Cited

U.S. PATENT DOCUMENTS

| | | | |
|---|---|---|---|
| 2,673,735 | 3/1954 | Niles et al. . | |
| 2,827,292 | 3/1958 | Koch . | |
| 3,053,532 | 9/1962 | Weidman . | |
| 3,212,622 | 10/1965 | Metz | 198/460 |
| 3,355,592 | 11/1967 | Muir | 198/460 X |
| 3,738,644 | 6/1973 | Kluge et al. | 198/437 X |
| 3,907,274 | 9/1975 | D'Amato et al. | 101/232 X |
| 3,959,190 | 5/1976 | Howard et al. | 198/441 |
| 4,004,694 | 1/1977 | Sjogren | 198/441 |
| 4,081,723 | 3/1978 | Vetter et al. | 101/232 X |
| 4,170,288 | 10/1974 | Mebus | 198/440 |
| 4,201,286 | 5/1980 | Meier | 198/461 |
| 4,266,654 | 5/1981 | Achelpohl et al. . | |
| 4,283,048 | 8/1981 | Muller . | |
| 4,333,559 | 6/1982 | Reist . | |
| 4,424,966 | 1/1984 | Chandhoke . | |
| 4,470,593 | 9/1984 | Halff et al. . | |
| 4,550,822 | 11/1985 | Meier | 198/461 |
| 4,555,101 | 11/1985 | Stobb . | |
| 4,585,227 | 4/1986 | Muller | 198/461 |

*Primary Examiner*—E. H. Eickholt

*Attorney, Agent, or Firm*—Laurence Brown & Associates

[57] ABSTRACT

A stream of shingled printed products coming off a press at high speed, with variable speed of conveyance and with variable shingle spacing, has alternate products divided into two streams conveyed at reduced speed. Thus two cyclically driven chains present alternating gripper links at a pickup station to grip and transport the alternate products along diverging paths for release on a corresponding pair of conveyor lines for the divided product streams. To conform with varying speeds and spacings, the gripper chain drive is synchronized to operate the grippers as each individual product arrives.

13 Claims, 9 Drawing Figures

HIGH SPEED ON-LINE RESHINGLING OF PRINTED PRODUCTS

TECHNICAL FIELD

This invention relates to the transport of shingled printed products, and more particularly it relates to on-line conversion of printed shingled products from one conveyed stream to two or vice versa.

BACKGROUND ART

In the printing arts high speed roto presses can print books, newspapers and the like products at very high speeds such as 90,000 per hour and supply these products in shingled form on output on-line conveyor streams. Because of the nature and speed of such equipment the shingled products do not have precisely controlled shingle spacing distances. These spacing distances tend to change with speed of the press and randomly for various reasons including frictional drag and defective products, etc. Thus, any on-line processing equipment need have the capabilities of operating at very high speeds to process products of variable spacing. If this is possible, further on-line processing equipment, such as trimmers, addressers, inserters, staplers, folders, etc., need be complex and expensive to process such randomly variable product spacings.

Because of this problem the capabilities of the high speed presses in the prior art have been more theoretical than actual, since they may need be slowed down to conform with the down stream processing equipment capabilities. The problem is even more complicated when it is necessary to use the down stream processing equipment for widely varying speeds, such as those encountered during press start up and shut down operations.

Because of these problems it has been customary in the high speed rotary press art to stack and store the products for processing by other down stream equipment. Representative prior art relating to the stacking and processing of printed products is found in patents to W. H. Weidman, U.S. Pat. No. 3,053,532, Sept. 11, 1962 and S. F. D'Amato, et al., U.S. Pat. No. 3,907,274, Sept. 23, 1975, and I. F. Niles, et al., U.S. Pat. No. 2,673,735, Mar. 30, 1954 and A. R. Stobb, U.S. Pat. No. 4,555,101, Nov. 26, 1985.

It is however an object of the present invention to provide an on-line printing system for processing high and variable speed press output streams that is compatible with state of the art down stream processors for shingled products.

In high speed on-line processors, it has been known to divert streams of products into alternative paths in batches as represented for example by patents to M. S. Chandhoke U.S. Pat. No. 4,424,966, Jan. 10, 1984 and F. Achelpohl et al. U.S. Pat. No. 4,266,654, May 12, 1981. One known mechanism provides for the combining of two successive shingled products into single gripper clamps of a set of cyclically presented such clamps for further processing at substantially lower product per hour rates, namely as set forth by W. Reist in U.S. Pat. No. 4,333,559, June 8, 1982. However, the processing of shingled stacked pairs of products in down stream equipment is unconventional and poses significant problems.

Therefore the prior art has not provided appropriate means or systems for segregating alternate ones of shingled products at on-line press delivery speeds into two streams at delivery speeds which can be processed by state of the art down stream equipment. Nor has equipment been provided for merging two on line streams of shingled products into a single stream of shingled products, which permits simplified systems having a single downstream line of further processing equipment.

DISCLOSURE OF THE INVENTION

This invention therefore provides improved high speed printing systems which transport shingled products on-line by means of a set of three conveyors and reshingling means that individually grip each shingled product to convert between a single stream of products and two streams of products transported in shingled array on the three conveyors.

In a preferred embodiment, a printing system with a variable speed printing press supplying shingled products along a single accompanying on-line conveyor delivery line has reshingling means for processing the on-line product stream to divide the stream into two streams of output shingled products conveyed with substantially constant shingle spacings between products at a lower product delivery rate than the on-line product delivery rate.

The reshingling means comprises transport means for gripping and transporting each of the input products delivered from a single input conveyer line by means of individually gripped products transported in paths designated by two sets of cyclically moving grippers respectively arranged to grip alternate ones of the products to transport them along diverging paths to deposit them in shingled array on a corresponding set of two output conveyors.

Synchronizing means detects the shingled spacing between the input products, which varies in response to press speed and other variables, and correspondingly locates the grippers in a position receiving the successive products as they are presented from the input line.

In this respect, a high speed press can deliver products at rates such as 90,000 per hour to be handled on line in a conversion to shingled products transported on separate conveyor lines at substantially half that rate, namely 45,000 per hour, so that they may be processed by conventional state of the art equipment operable on line at that speed.

BRIEF DESCRIPTION OF THE DRAWINGS:

In the accompanying drawings:

FIG. 6 is a side elevation view of the conveying system afforded by this invention, FIG. 7 is a block schematic diagram of synchronization means afforded by this invention to match the input products delivered at variable shingle spacings with the presentation of grippers in the reshingling means, and FIG. 8 is a block system diagram of a further embodiment of the invention wherein the reshingling means merges shingled products delivered on two conveyer lines into a single output stream along a third conveyor line.

THE PREFERRED EMBODIMENTS

Figure 1:
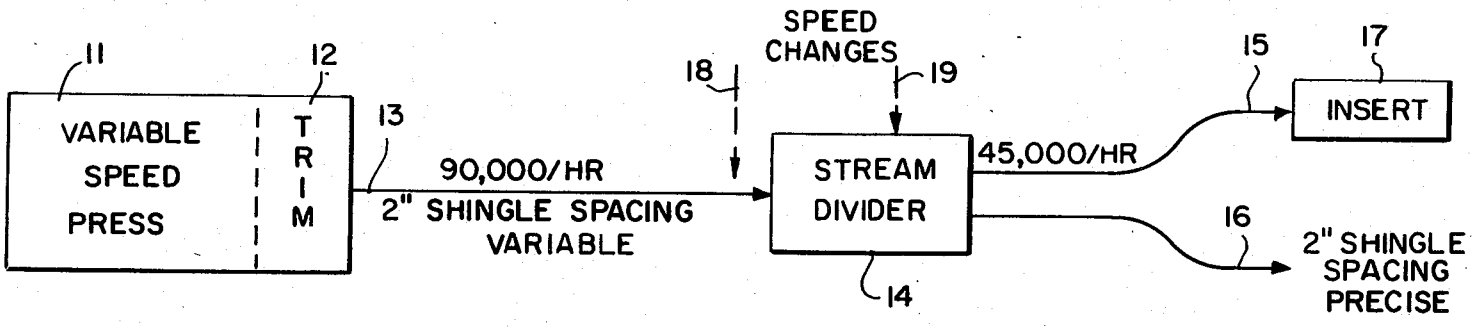
FIG. 1 is a block diagram system of preferred printing system afforded by this invention for converting an on-line high speed shingled product stream to two slower speed streams by reshingling alternately presented individual products from the initial input stream into two output streams.

Now with reference to the drawings, the general system organization of the preferred embodiment of the invention is shown in FIG. 1 in block diagram form. Therein, a high speed rotary press 11 incorporating associated trimmers, 12, etc. provides output shingled printed products on conveyor line 13 at rates such as 90,000 per hour. The products are typically shingled at about two inch spacings, which are variable, particularly as the press speed varies, such as in start up and shut down. Also, from time to time a product may be missing, such as if damaged and removed by equipment like that of H. Muller, U.S. Pat. No, 4,283,048, Aug. 11, 1981.

In accordance with this invention, a stream divider 14 is provided to reshingle the products on two conveyor lines, 15 and 16, where the product rate is substantially halved, thus making it feasible to process the products with state of the art downstream equipment such as inserter 17. Furthermore, the shingle spacing is uniformly established to avoid down stream problems of handling variable and random spacings.

It is noted that in the reshingling process, two speed changes are encountered, as schematically shown by the lines 18 and 19. Thus, the press speed on conveyor line 13 is increased at transition position 18, for purposes more fully explained hereinafter. Subsequently when the products are divided into two streams, the conveyor lines 15 and 16 are moving more slowly to provide the products at substantially half the input document rate if the shingle separation distances are maintained substantially equal.

Figure 2:
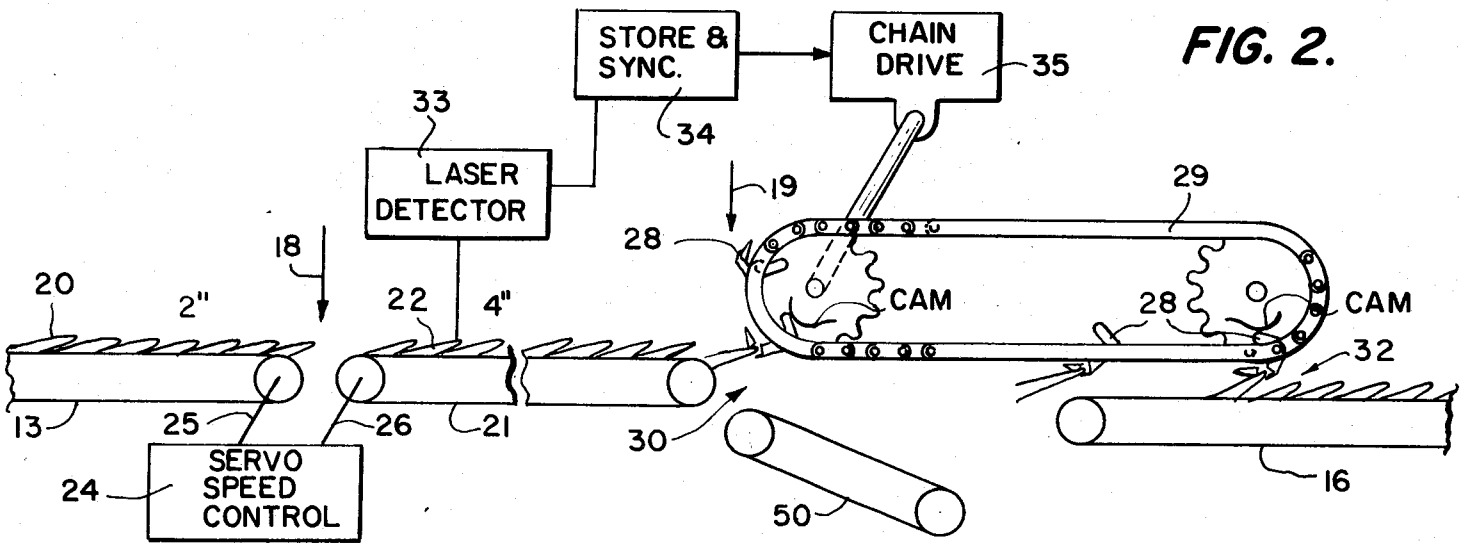
FIG. 2 is a diagrammatic system side view sketch, partly in block diagram, of reshingling means as afforded in a preferred embodiment of this invention.
Figure 3:
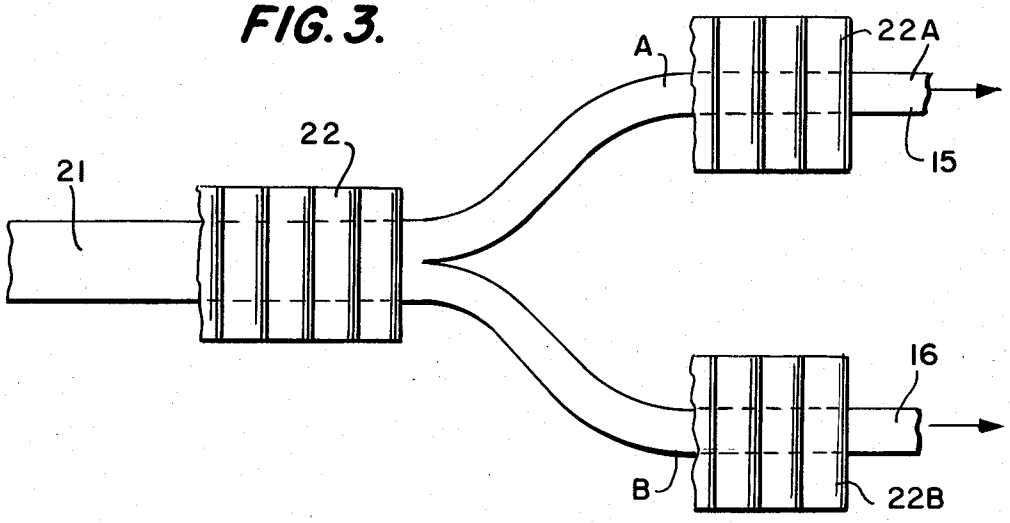
FIG. 3 is a plan view segmental sketch of that part of the product transport means of FIG. 2 showing the cyclic gripper paths carrying products along diverging paths from a single input conveyor to two output conveyors.

In FIGS. 2 and 3 the reshingling stream divider is shown diagrammatically. The input printed products 20, such as newspapers, books, or the like, are conveyed as taken from the press with variable shingle spacings, but nominally at full press speed being represented typically as two inches. An intermediate feed conveyor 21 runs at higher speed and thereby increases the shingle spacing gap between the products 22 on the higher speed conveyor belt. In order to synchronously process the products as the press speeds vary, such as during start-up and shut-down, or when for other reasons a different press speed is chosen, a servo speed control system 24 is provided. Thus, the actual speed of the delivery shaft 25, or other indicator, is detected, and the servo speed control system 24 thereby drives the conveyor belt drive shaft 26 synchronously therewith, such as by controlling the speed of a d-c drive motor.

The speed conversion does not change the variable shingle spacing gap between successive products 22 on the high speed conveyor belt 21. This produces a significant feed problem for individually gripping the successive products by the cyclically presented gripper clamps 28 rotatably carried by the carrier chain 29. Accordingly the speed of the drive means 35 for the chain is varied by a further servo control system 31 as the spacings between the products 22 varies thereby assuring proper feed of individual products into the reshingling stream divider afforded by this invention.

In general, the illustrated servo system 31 employs an optical detector 33, such as a laser detector, for providing a signal at each leading shingled edge of the documents 22 carried along the conveyor 21. This establishes an exact reference timing position at which the product will be presented to a gripper clamp 28 at the input product pickup station, which reference timing position is stored as a synchronization signal, preferably in an electronic storage system 34. With the synchronization data on hand, the chain drive means 35, such as a variable speed d-c motor, is actuated to assure proper feeding through the reshingling mechanism of products arriving at different product rates per unit time and of products having variable shingle gap distances for one reason or another.

If the inertia of the chain drive system is such that it cannot respond instantaneously to successive gap spacing differences, then the gap spacings of a plurality of successive products, such as five, may be averaged. A typical system operable in this manner is shown in FIG. 7. This resolves the most frequently encountered feed problems, which occur during changes of press speed, and thus permits the carrier chain 29 to follow any changes of press speed.

As may be seen in FIG. 7, the normal shingle spacing gap x is presented between successive products 22, but if a product is missing the extraordinary spacing gap y is present. This is important if the spacings are averaged over a number of products. The detector 33 then detects the leading edges of the product to provide edge signals, which are processed in gap counter 36 driven by oscillator 37, such as by gating, to register a sequence of gap counts representing product spacings. These are readily averaged over a sequence of five counts, but the unusual circumstances posed by a missing document would then cause misregistration and jamming. Thus the window 38 will detect and immobilize the extraordinary gap distances y. The data is stored in delay mechanism 39 to compensate for the distance of travel time between the detector 33 and the chain driven gripper clamp 28. In this embodiment, the digital correction data for adjusting the chain speed a carrier chain 29 is converted to an analog signal in d/a converter 40 for driving the chain drive motor 35 at the proper speed to assure proper feed of the products. The integrator or averaging circuitry is symbolized at 41, where it could conveniently be for example an R-C storage circuit in the d-c drive voltage system of the variable speed chain drive motor 35, which would effectively average out the accumulated gap spacing changes of several successive products. This function can of course be achieved with appropriate digital processing circuitry.

Figure 5A:
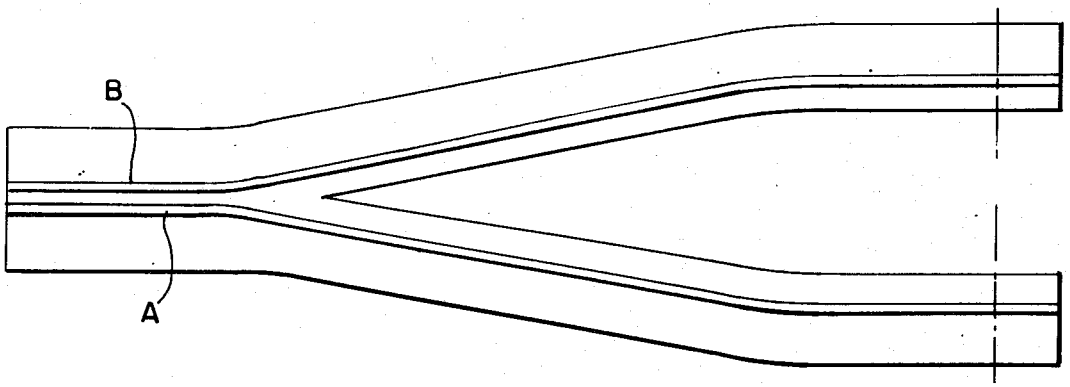
FIG. 5A is a plan view showing the tracks along which the rollers shown in FIG. 4 travel.
Figure 4:
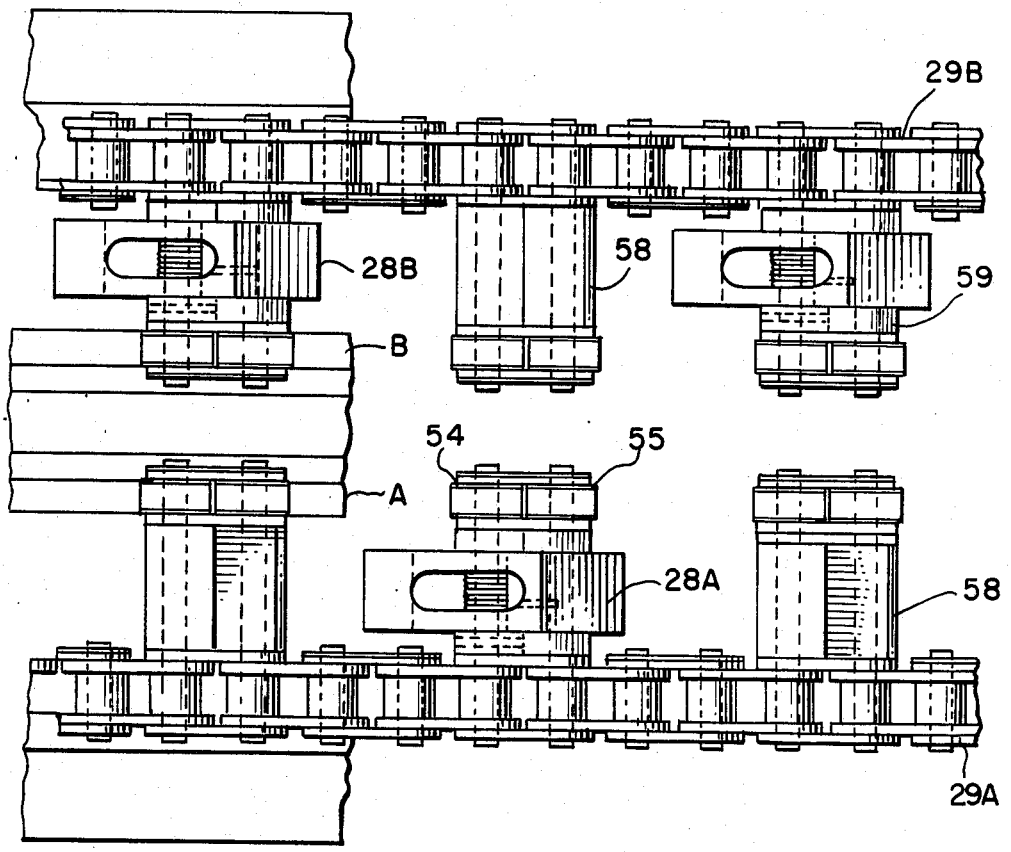
FIG. 4 is a plan detail view of a segment of the pair of chain link carried gripper sets transporting products in the reshingling portion of the system.
Figure 5:
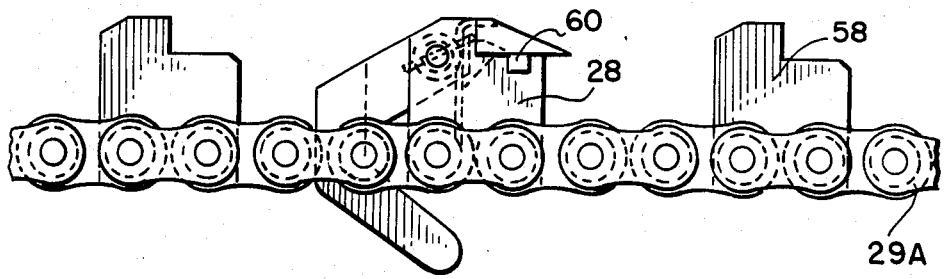
FIG. 5 is a segmental side view of the gripper carrying link chain showing alternating gripper and product stop elements cyclically presented by the chain.

Returning to the views of FIGS. 2 and 3, taken along with the views of the drive chain and gripper mechanisms in FIGS. 4 and 5, the reshingling operation will now be addressed. The details of the chain drive and gripping mechanism need not be shown at this stage of the art, where for example the herinbefore mentioned Reist mechanism is known as well as other gripper-chain mechanisms shown for example in patents to W. Koch, U.S. Pat. No., 2,827,292, Mar. 18, 1958 ad A. Halff, et al., U.S. Pat. No. 4,470,593, Sept. 11, 1984.

This mechanism departs from the conventional, in that: two concurrently driven endless chains are driven by a common drive 35, to meet jointly at a single conveyor line 21 and to diverge singly along an appropriate track (see FIG. 5A) to meet two further conveyor lines 15, 16. In general the gripper clamps 28 are cyclically presented by the respective chains to both input and output stations. In FIG. 2 therefore the gripping clamps are cammed open at an input station 30 for receiving the products from conveyor 21 and are quickly closed to transport the products individually along the chain path of carrier chain 29 to a discharge station 32, shown at the input end of conveyor 16, where the products are released in shingled array. Any rejected or dropped products are conveyed out of the system on conveyor belt 50.

As the products 22 are presented by conveyor 21, they encounter the side by side carrier chains 29A and 29B as shown in FIG. 4. Note that the respective gripper clamps 28A and 28B are staggered relative to each other on the respective chains to be alternately presented at the input loading station 30. The chain drive 35 is timed then to choose alternate ones of the incoming products 22 for the respective conveyor lines 15 and 16, and thus to divide the incoming stream into two output streams of products. Therefore, the chains 29A and 29B are passed in a diverging path, such as shown in FIG. 3 to communicate with the output conveyors 15 and 16.

Note in FIG. 4 that the gripper clamps 28A and 28B are stabilized by a set of two rollers 54, 55, which roll on respective tracks A and B (see also FIG. 5A) which along with the corresponding chain following the tracks define the diverging path of the output products 22A and 22B carried by the respective gripper clamps of the two chains. Note also in FIG. 4 that opposite to the gripper clamps 28, as carried by the opposing chain, are product stop members 58, which serve along with the mating clamps 28 to align a product at the input station. Toothed gripper surfaces 59 are provided, or alternatively a plastic tubing 60 is embedded in one gripper jaw in a semicircular indentation thus to assure proper gripping and transport of the printed products in the gripping jaws.

The higher speed conveyor belt 21 of FIG. 2 assures that with variations of shingled spacings of products, that they are moved into the open gripping clamps against the stops for proper gripping. With the output conveyors 15, 16 synchronized in speed with the chain drive 35, because of the fixed spacing of the gripping clamps, the output products are shingled with precise shingle gaps for further downstream processing by any equipment that is sensitive to variable product spacings.

The side view drawing of the equipment sketched in FIG. 2, as shown in FIG. 6, shows the conveyance path through the reshingling device afforded by this invention, as provided in a stream dividing embodiment. Like reference characters are used for defining similar features.

A framework 52 mounts the various parts in their cooperative positions. The input products come to nip roller 54 for entry into the higher speed conveyor belt system 21. This carries the products into the reshingling chain drive 29, operable as before described to carry the products through to one of the output conveyor lines 16. Any products that fail to properly enter the clamping grippers carried on chain 29 will fall on the removal conveyor system of belt 50 and corresponding outlet belt 56 to carry the products out the lower far side of the console. The framework 58 is to orient the droop of the products carried by the clamps to establish a substantially horizontal product position for entering and dropping onto belt 16.

A further embodiment of the invention is shown in FIG. 8, wherein the products are passed in an opposite direction through the reshingling mechanism. Thus two conveyors 81, 83 pass products into the reshingling device for merger into a single shingled output on the single output conveyor 85. In this embodiment the chain drive converges in the direction of the product travel. In the manner before described, the chain carried gripping clamps receive the input products from the respective shingled arrays at conveyors 81 and 83, pick them up for transport at the stations 86, 88 and convey them to a release station 89, where they are dropped in reshingled form on conveyor 85. As in the preferred stream divider embodiment, the heart of this embodiment is the reshingling mechanism, wherein two chains have a common side by side path at one conveyor, and are separated for independent paths communicating with two other conveyors.

From the foregoing, it is evident that improved reshinglers and high speed printed product handling systems are afforded by this invention. Thus, the features of novelty believed descriptive of the spirit and nature of the invention are set forth with particularity in the following claims.

I claim:

1. A printing system for downstream processing of shingled products conveyed from a variable speed printing press, comprising in combination, a variable speed printing press for providing a plurality of printed products, on-line conveyor delivery means downstream of said printing press for receiving printed products and for presenting printed products in shingled relationship in a press output stream at a predetermined product rate, reshingling means for processing the on-line product stream to divide the stream into two continuous streams of output shingled products conveyed at a product rate substantially less than said predetermined rate.

2. A system as defined in claim 1 wherein the spacing of shingled products in the press output stream is variable, and including product handling means for receiving the press output stream and for reshingling output products with a substantially constant shingled spacing between products.

3. A stream divider system for processing a plurality of shingled printed products to alternately direct individual products from a single conveyor line to two separate conveyor lines, comprising in combination, transport means for gripping and transporting each of the products delivered along said single conveyor line and including two sets of grippers cyclically moving in individual paths between the single conveyor line and the two separate conveyor lines, and actuating means for actuating the grippers in the respective sets to grip alternate products from said single conveyor line and to release the products in shingled format on the respective two separate conveyor lines.

4. A high speed conveying system for reshingling continuously moving shingled printed products, comprising in combination, first, second, and third conveyor means for conveying said shingled printed products along respective predetermined conveyance paths, and reshingling means extending between said first conveyor means and each of said second and third conveyor means for conveying the products between the first, second, and third conveyor means, said reshingling means including individual gripping means for gripping the products and carrying the gripped products between respective ones of said conveyors, transport means for sequentially presenting a plurality of sets of individual gripping means and for carrying alternate ones of said gripping means between said first and said second conveyors and between said first and said third conveyors, respectively, thereby to accommodate individual ones of the shingled products in individual gripping means, said gripping means having clamping means operable to receive and grip an individual product carried on one of said conveyors and for closing said gripping means to convey the gripped product to another of said conveyors and for opening said gripping means at said other conveyor to discharge the product on said other conveyor in shingled relationship with other products thereon.

5. A conveying system as defined in claim 4 wherein each of the second and third conveyor means carries shingled products into the reshingling means for gripping individual shingled products at diverged positions and for conveyance of the individual shingled products to said first conveyor means and into a single merged stream of shingled products for thereby conveying all of said shingled printed products from a pair of conveyor means and for transfer of the products in reshingled form on a single conveyor means.

6. A conveying system as defined in claim 4 wherein said first conveyor means carries shingled products moving in a single stream on said first conveyor means, and said shingled products pass into said reshingling means and are transported thereby to said second and third conveyor means to divided the single stream of products into two separated streams of products.

7. A conveying system as defined in claim 6 including driving means for driving said first conveyor means to carry the shingled products at substantially twice the product speed of the products on said second and third conveyor means.

8. A conveying system as defined in claim 6 including printing press means positioned upstream of said first conveyor means for providing a plurality of printed products to said first conveyor means, wherein the shingled products carried by said first conveyor means are conveyed at a speed substantially corresponding to printing a discharge printing speed of printed products from the press means, and including synchronizing means for synchronizing the speed of the transport means with the speed of the first conveyor means to present the gripping means in synchronism with the arrival of shingled products for gripping thereby.

9. The conveying system defined in claim 8, including detector means positioned to detect the spacing between corresponding parts of shingled products carried by said first conveyor means and for providing an output signal, wherein the synchronizing means includes averaging means responsive to averaged product spacing distance between successive products carried by said first conveyor means, and the synchronizing means includes means for detecting abnormalities of product spacing distances, such as occur when a product is missing from the shingled sequence, and adjusting means for adjusting the transport means to vary the position of the gripping means in response to averaged variations of product spacing of said plurality of shingled products.

10. The conveying system of claim 8 including speed increasing conveyor belt means positioned between said first conveyor means and said transport means for substantially doubling the spacing between corresponding parts of successive shingled products, and synchronization means for controlling the speed of the speed increasing conveyor belt means in proportion to variations in the speed of said first conveyor means.

11. The conveying system of claim 4 wherein the transport means further comprises a pair of endless cyclically movable link chains having the gripping means attached at spaced link positions in the respective chains.

12. The conveying system of claim 11 wherein each gripping means extends laterally from the respective chain and terminates in a set of rollers, and roller track means for receiving the rollers of the respective gripping means to define diverging pathways along which the rollers ride.

13. The conveying system of claim 11 including product stop means aligned with each gripping means in the chain for presenting an abutment for products being moved into the gripping means.

* * * * *